US007404531B2

(12) United States Patent
McConnell

(10) Patent No.: US 7,404,531 B2
(45) Date of Patent: Jul. 29, 2008

(54) TRASH BAG HOLDER WITH HANDLE

(76) Inventor: Peter McConnell, 330 W. I St., #21, Encinitas, CA (US) 92024

( * ) Notice: Subject to any disclaimer, the term of this patent is extended or adjusted under 35 U.S.C. 154(b) by 0 days.

(21) Appl. No.: 11/526,284

(22) Filed: Sep. 25, 2006

(65) Prior Publication Data

US 2007/0210216 A1 Sep. 13, 2007

Related U.S. Application Data

(60) Provisional application No. 60/779,833, filed on Mar. 8, 2006.

(51) Int. Cl.
*B65B 67/12* (2006.01)
*B65B 67/04* (2006.01)

(52) U.S. Cl. ..... 248/95; 248/99; 141/316

(58) Field of Classification Search ..... 248/95, 248/99–101, 145.6, 153, 146, 155.1, 175, 248/302, 215; 141/316, 390, 391; 224/924, 224/420, 449
See application file for complete search history.

(56) References Cited

U.S. PATENT DOCUMENTS

| | | | | | |
|---|---|---|---|---|---|
| 435,474 | A | * | 9/1890 | Young | 248/100 |
| 477,235 | A | * | 6/1892 | Timmerman | 248/99 |
| 490,578 | A | * | 1/1893 | Merry | 248/99 |
| 544,585 | A | * | 8/1895 | Mayo | 141/341 |
| 657,284 | A | * | 9/1900 | Eddy | 248/100 |
| 973,414 | A | * | 10/1910 | Eastham | 248/100 |
| 1,045,281 | A | * | 11/1912 | Gunderson | 248/101 |
| 1,240,852 | A | * | 9/1917 | Scheffler | 248/100 |
| 1,713,095 | A | * | 5/1929 | Scheffler | 248/101 |
| 2,064,696 | A | * | 12/1936 | Smith et al. | 43/55 |
| 2,261,511 | A | * | 11/1941 | Baker et al. | 248/95 |
| 2,462,973 | A | * | 3/1949 | Kelrick | 248/101 |
| 2,903,215 | A | * | 9/1959 | Metcalf | 248/99 |
| 3,788,720 | A | * | 1/1974 | Schneider | 312/211 |
| 4,238,868 | A | | 12/1980 | Sternberg | |
| 4,445,658 | A | * | 5/1984 | Ferron | 248/99 |
| 4,832,291 | A | | 5/1989 | Nelson et al. | |
| 4,892,277 | A | * | 1/1990 | Tobis | 248/101 |
| 4,919,546 | A | | 4/1990 | Imazeki et al. | |
| 4,957,252 | A | * | 9/1990 | Watkins | 248/97 |
| 4,971,274 | A | | 11/1990 | Mitchell | |
| 5,014,943 | A | | 5/1991 | Nelson et al. | |
| 5,020,751 | A | | 6/1991 | Larkin | |
| 5,031,948 | A | | 7/1991 | Groth et al. | |
| 5,154,378 | A | | 10/1992 | Plum | |
| 5,163,645 | A | | 11/1992 | Caruso | |
| 5,350,142 | A | * | 9/1994 | Kurtzman et al. | 248/99 |
| 5,718,400 | A | * | 2/1998 | Dwy | 248/99 |
| 6,517,033 | B2 | | 2/2003 | Russell et al. | |
| 6,726,156 | B1 | | 4/2004 | Scola | |

* cited by examiner

*Primary Examiner*—Kimberly T. Wood
(74) *Attorney, Agent, or Firm*—Steven W. Webb

(57) ABSTRACT

An improved plastic trash bag holder is presented. The invention will hold a standard t-shirt shopping bag firmly and permit the bag to be held in the hand by means of an attached handle or placed on a vertical flat surface by means of screw or other attachments mechanisms.

3 Claims, 5 Drawing Sheets

TRASH BAG HOLDER WITH HANDLE

RELATED APPLICATIONS

This application completes and extends Provisional Patent Application 60/779,833, filed Mar. 8, 2006.

FIELD OF THE INVENTION

This invention relates to devices for managing, handling, and recycling plastic "T-shirt bags" to be used as trash bags in a home or business office environment.

BACKGROUND OF THE INVENTION

Inventions like the present one are used to manipulate plastic "T-shirt bags" intended for home use or in a business office. The devices support the bag and hold it open for easy use, making it more likely that objects to be placed in the bag make it inside. When the bag is detached from the holder, it can be used to throw the contained trash away.

Trash bags used are usually plastic with handles already provided. The present invention uses unique handle restraint devices on its frame to hold the bag by its handles, allowing it to dangle freely from the frame.

The current state of the art includes similar bag restraint devices without the present invention's features. For example, U.S. Pat. No. 5,031,948 to Groth teaches a bag handling system that consists of two interlocking frames that snap together and a scoop to help with loading the bag. U.S. Pat. No. 6,517,033 to Russell & Retka shows a bag holder that hangs from a wall or door and possesses a simple bag handle restraint system.

The present invention possesses several features not anticipated by these inventions, and others, including a simple handle restraint system that accommodates multiple-sized handles and a simple, single-frame support that can be attached removably to a cabinet door, or used with a fold-out handle to allow the bag holder to be carried. These and other features distinguish the present invention from the prior art, and make it a unique contribution.

SUMMARY OF THE INVENTION

The present invention adds to the state of the art by adding simple portability of the frame with removable attachment to a vertical surface. As is shown below, the handle for carrying the device also contains the attachment mechanism. The attachment mechanism has two attachment points so that longer bags can be accommodated as well as standard short market bags.

The present inventions makes use of plentiful plastic shopping bags, "t-shirt bags", used by major supermarkets and retailers such as Wal-Mart™. These bags come in standard sizes with a predefined bag handle size. The most plentiful are the shorter bags, used at all supermarkets. Longer bags are also available and can be handled by this invention.

The preferred embodiment of the bag holder is a simple, sturdy wire frame design with one bag handle restraint point on each side, a rectangular wire opening, and a simple rotating handle design that permits the holder to be used to carry shopping bags in a hand-held fashion or to depend the bag holder from a single attachment point. The attachment point can be a simple slot holster or a screw or other protruding object. The wire frame possesses two bumpers that stabilize the bag holder and prevent it from banging against the vertical surface.

In an alternate embodiment, the present invention will consist of a rectangular plastic frame with bag attachment points as shown, possessing a rotating handle that can be locked into an upward or down position. In the up position, the handle can be used to attach the frame to a vertical surface, such as the inside of a cabinet door under a kitchen sink, using a. particular hanging system necessary for minimal effort (one motion) in attaching or detaching; this is achieved by using only one screw on which the device is hung and locked into place, while maintaining stability from adjustable bumpers.

The handle possesses two carrying handle attachment points which can be hung over a screw inserted in the door.

In the down position, the carrying handle can be used to carry the frame with a bag attached while the user is gathering trash, such as litter or dog feces. The bag is attached at the bag attachment points on opposite sides of the frame. The bag attachment points are designed to permit the user to wind the plastic bag handles around them and thereby restrain the bag such that the inside of the bag is easily available to be used for trash.

The present invention is simple to manufacture, has a minimum of moving parts, and has multiple applications. It is designed to use throwaway plastic "t-shirt" bags brought home from the supermarket and does not require specially-shaped bags to be used.

DETAILED DESCRIPTION OF THE INVENTION

Figure 5:
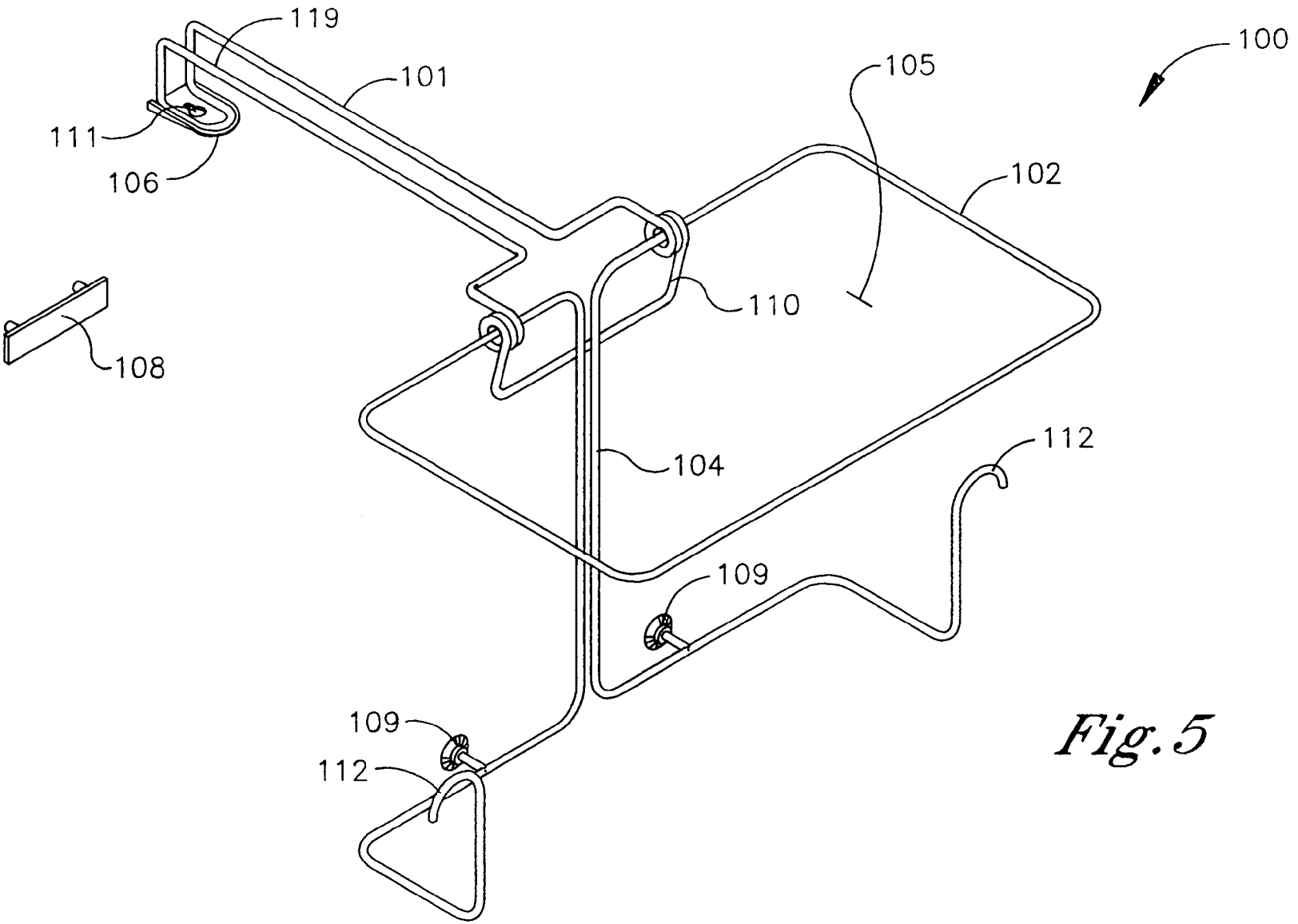
FIG. 5 is a perspective view of the preferred embodiment of the invention

The preferred embodiment of the invention is shown in FIG. 5. This embodiment of the invention 100 possesses a wire frame construction that confers light weight and rigidity. The handle 101 is connected to the bag holder frame 102 such that the handle restraint bar 110 can connect with the backbone 104 of the bag holder frame 102 and permit the invention to be held by hand while the top opening 105 of the bag holder frame 102 is horizontal.

There are three modes in which the invention hangs from a fixed support. In the first vertical mode, the handle 101 is allowed to hang vertically, the handle attachment device 106 is inserted into the attachment slot 108 attached to a vertical surface, and the bag holder frame 102 rests against the vertical surface at the bag holder frame bumpers 109.

In the second vertical mode, the handle attachment device, which possesses a handle attachment opening 111, is placed over a protruding object such as a screw or a nail attached to the vertical surface. The weight of the bag holder frame 102 and the attached T-shirt bag (not shown) and the contents of the T-shirt bag is borne by the screw and the handle 101.

In the third vertical mode, the hook space 119 between the handle attachment device 106 and the handle 101 itself is used to hook over a horizontal straight edge such as a cupboard door top or a closet door The weight of the bag frame 102 and the T-shirt bag is borne by the hook space 119.

The invention possesses two T-shirt bag handle restraints 112 that hold the T-shirt bag handle openings for a standard T-shirt bag. The T-shirt bag is attached to the invention 100 by pulling the T-shirt bag up through the top opening 105 by means of the T-shirt bag handles and then folding each handle of the T-shirt bag over the rim of the top opening 105 such that the T-shirt bag handle loop is hooked around each T-shirt bag handle restraint 112.

The T-shirt bag is then held firmly by the invention 100 and can be filled with trash in either the handle down mode where it is carried by hand or in one of the vertical modes, attached to a vertical surface.

Figure 1:
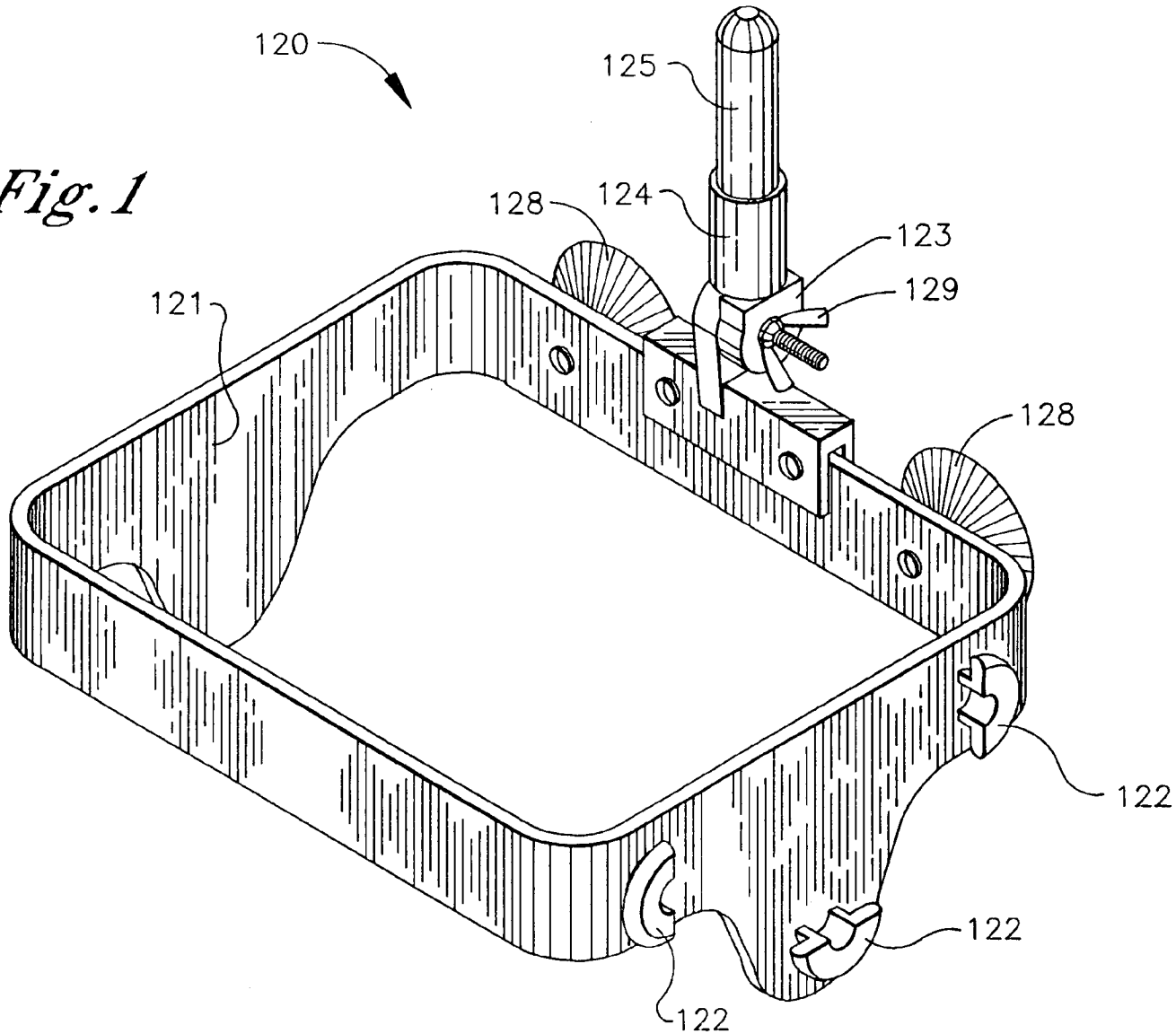
FIG. 1 is a perspective view of an alternate embodiment of the invention.

The present invention is shown in an alternate embodiment 120 in FIGS. 1 through 4. The rectangular frame 121 is made of plastic, with the bag attachment points 122 cast separately and attached fixedly with glue or other means. The handle connection mechanism 123 is shown in FIG. 1 to be screwed on but in this embodiment is glued after separate casting. The handle rotation control mechanism 125 is a ratcheted with attached butterfly nut 129, permitting the handle 126 to be moved between the up and down position.

Figure 2:
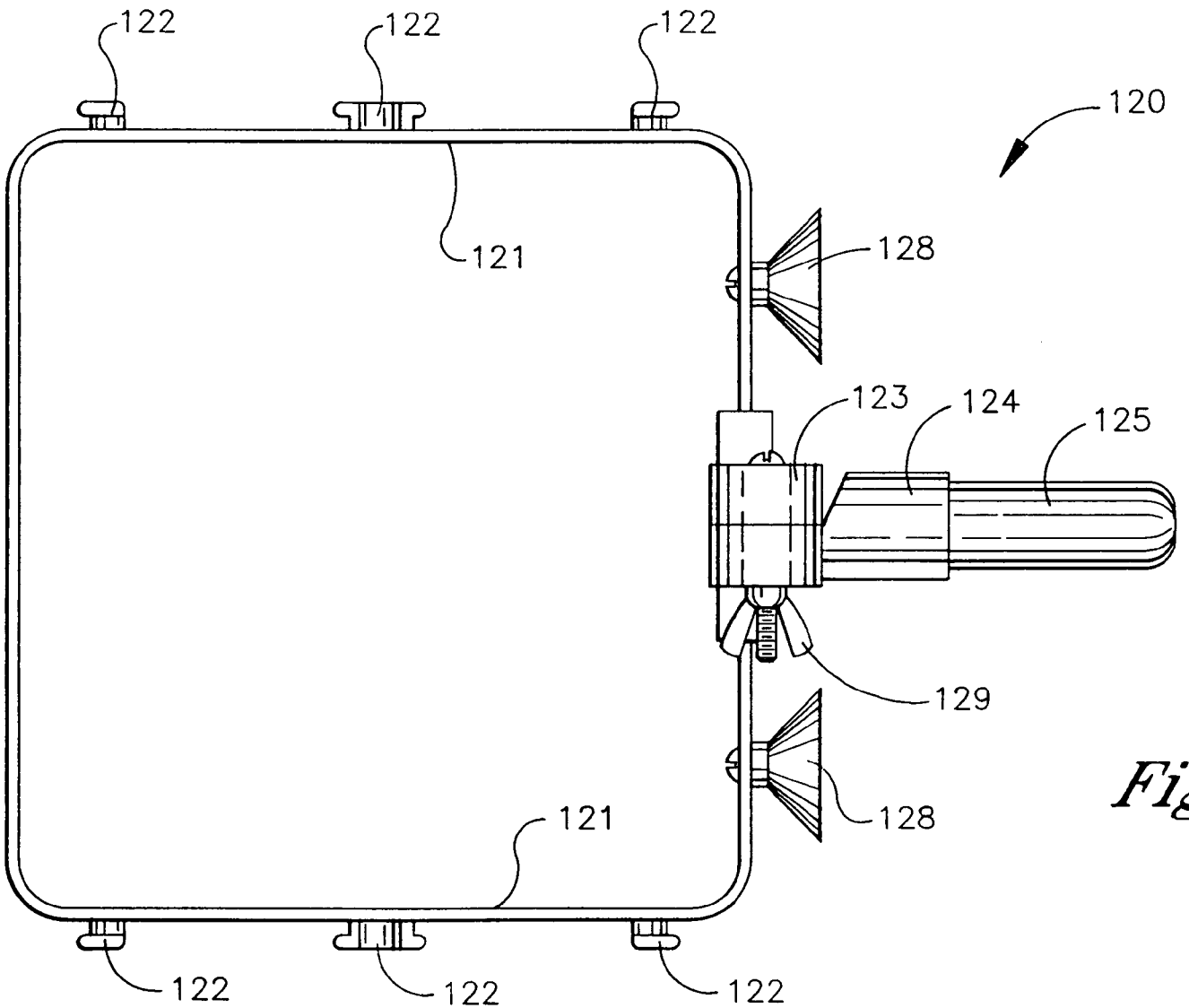
FIG. 2 is a top view of an alternate embodiment of the invention.

FIG. 2 shows the top view of the device, with the profile of the bag attachment points 122. These bag attachment points 122 are designed to allow a standard thickness shopping bag handle to be wound around them to secure the bag.

Figure 4:
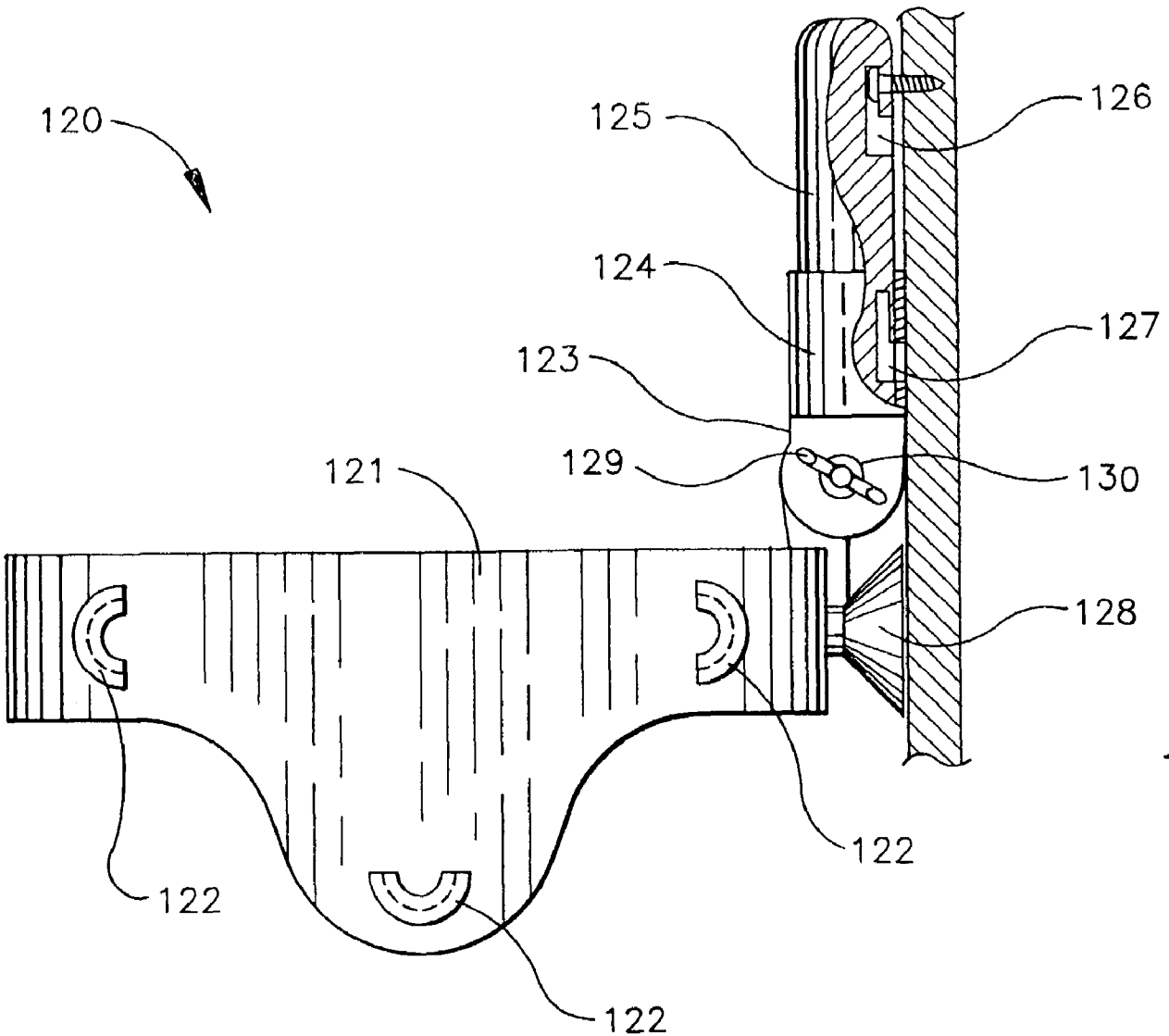
FIG. 4 is a side view of an alternate embodiment of the invention with the handle up

The handle 123 as shown is optionally in two pieces: a handle receiver 124 made of plastic and a handle part 125 made optionally of wood but in the preferred embodiment also made of plastic. The handle part 125 optionally screws into the handle receiver 124. The handle part 125 possesses two handle attachment points 126,127 as shown in FIG. 4 in cutaway view. In an alternate embodiment, the handle receiver 124 and handle part 125 are cast together into a single handle with the two handle attachment points 126,127 cast into it.

The upper handle attachment point 126 is used for the standard short shopping bags and the lower one for longer plastic bags. The handle 123 is in the "up" position in FIG. 4 and the circular bumpers 128 in the handle side of the frame allow the invention 120 to stand away from the surface of the wall or door the invention 120 is suspended from. The circular bumpers 128 confer increased stability and prevent the frame 121 from rotating around the suspension point at the handle attachment point 126,127.

Figure 3:
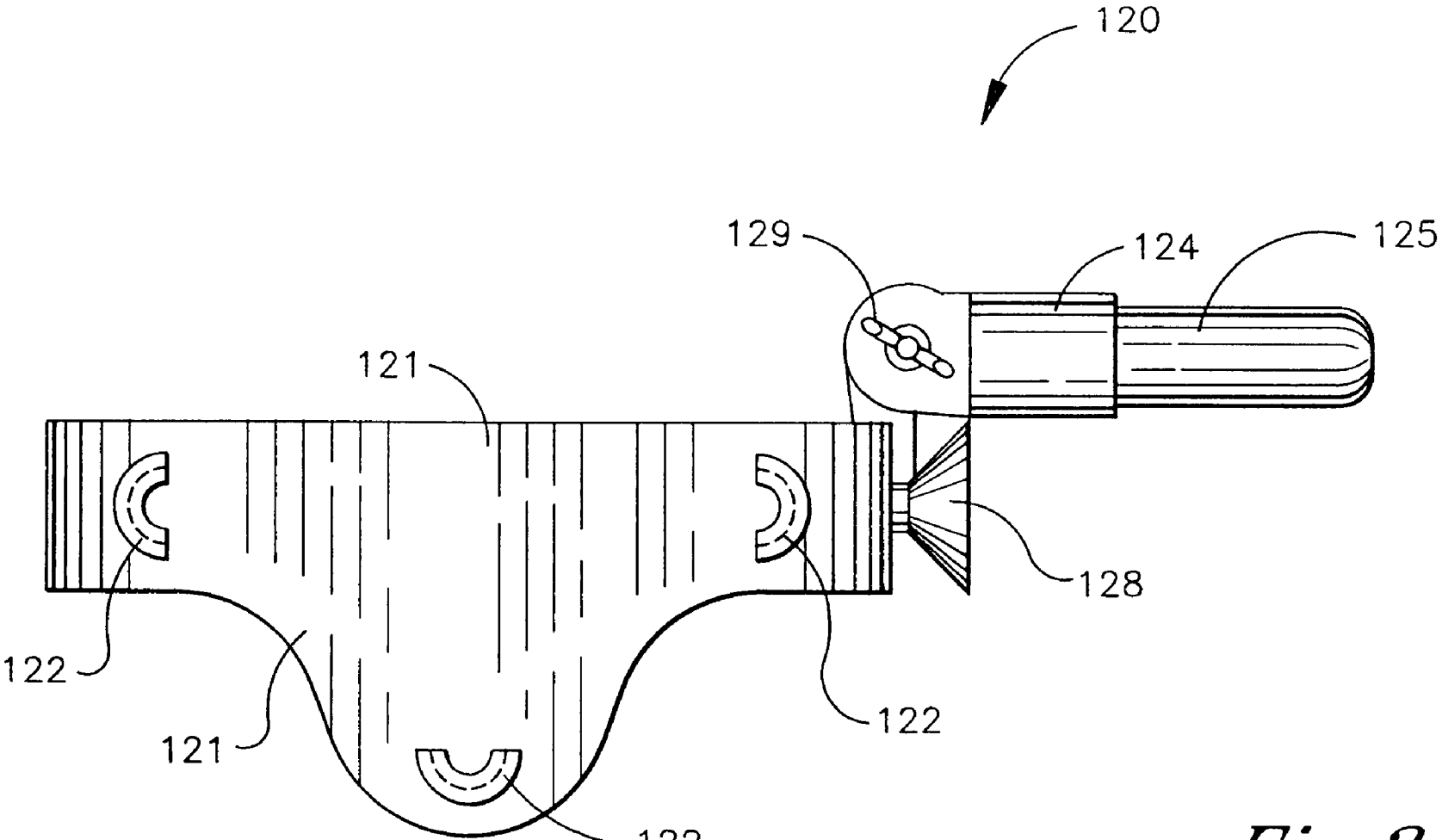
FIG. 3 is a side view of an alternate embodiment of the invention with the handle down

FIG. 3 shows the invention 120 with the handle 123 in the "down" position, where it can be used to carry the frame 121 and attached bag for easy use in collecting litter. The handle rotation control mechanism 130 is strong enough so that when the butterfly nut 129 is tightened down, the ratchet will not rotate while the bag is attached to it and being carried.

While the foregoing describes a preferred embodiment and several alternative embodiments, variation on this design and equivalent designs may be resorted to in the scope and spirit of the claimed invention.

What is claimed is:

1. A trash bag holder comprised of a rectangular frame, the rectangular frame possessing a plurality of bumpers at its lower extremity, the rectangular frame possessing an upper opening large enough to accommodate a standard plastic "t-shirt" shopping bag having handles, the upper opening possessing a handle attached to the upper opening in manner such that the handle is free to rotate between a vertical and a horizontal orientation, the rectangular frame possessing a plurality of trash bag handle restraints, the handle comprised of a handle stem, a plurality of handle attachment means, and a frame attachment means, the plurality of handle attachment means located at the end of the handle away from the upper opening of the rectangular frame, the frame attachment means at the end of the handle away from the plurality of handle attachment means, the frame attachment means connecting the handle to the upper opening such that the handle can be rotated from an orientation perpendicular to the geometric plane formed by the upper opening to a position parallel to said plane, the plurality of trash bag handle restraints located on the rectangular frame such that a standard plastic "t-shirt" shopping bag can be drawn up through the upper opening of the rectangular frame and the handles of said bag be folded over the rim of the upper opening and secured around the trash bag handle restraints such that the bag cannot slide out of the upper opening.

2. The trash bag holder of claim 1 where the rectangular frame, the handle, and the trash bag handle restraints are comprised of stiff wire.

3. The trash bag holder of claim 2 where the frame attachment means is comprised of a simple wire stop on the handle that rests against the rectangular frame.

* * * * *